US006031336A

United States Patent [19]

Rumbaugh et al.

[11] Patent Number: 6,031,336

[45] Date of Patent: Feb. 29, 2000

[54] FIELD EMISSION DISPLAY AND METHOD FOR THE OPERATION THEREOF

[75] Inventors: Robert C. Rumbaugh, Scottsdale; Robert T. Smith, Tempe; Johann Trujillo, Mesa; Chenggang Xie, Phoenix; Scott V. Johnson, Scottsdale; Curtis D. Moyer, Phoenix; David M. Rice, Chandler, all of Ariz.

[73] Assignee: Motorola, Inc., Schaumburg, Ill.

[21] Appl. No.: 09/098,769

[22] Filed: Jun. 17, 1998

[51] Int. Cl.[7] ..... G09G 3/10

[52] U.S. Cl. ..... 315/169.3; 315/169.1; 313/309; 313/495

[58] Field of Search ..... 315/169.3, 169.1; 313/309, 495, 336, 351

[56] References Cited

U.S. PATENT DOCUMENTS 4,281,272 7/1981 Spilsbury ..... 315/1
5,229,682 7/1993 Komatsu ..... 313/309
5,396,151 3/1995 Cappels, Sr. ..... 315/8
5,541,473 7/1996 Duboc, Jr. et al. ..... 313/422
5,801,486 9/1998 Johnson et al. ..... 313/495
5,804,909 9/1998 Nilsson et al. ..... 313/309

*Primary Examiner*—Haissa Philogene
*Attorney, Agent, or Firm*—Jasper Dockrey; S. Kevin Pickens; Kevin D. Wills

[57] ABSTRACT

A field emission display (100) includes a cathode plate (110) having a plurality of electron emitters (114), an anode plate (122) having an anode (124) connected to a potential source (126), and an anode voltage pull-down circuit (127) having an input (106) and an output (104). Output (104) is connected to anode (124), and input (106) is connected to potential source (126). Preferably, anode voltage pull-down circuit (127) causes an anode voltage (120) at anode (124) to drop to about ground potential prior to generation of a discharge current by electron emitters (114) for neutralizing positively electrostatically charged surfaces (137, 138) within field emission display (100).

45 Claims, 8 Drawing Sheets

100

FIELD EMISSION DISPLAY AND METHOD FOR THE OPERATION THEREOF

REFERENCE TO RELATED APPLICATION

Related subject matter is disclosed in a U.S. patent application entitled "Method for Reducing Charge Accumulation in a Field Emission Display", having the application Ser. No. 09/009,233, filed on Jan. 20, 1998, and assigned to the same assignee.

FIELD OF THE INVENTION

The present invention relates, in general, to field emission displays, and, more particularly, to methods for reducing charge accumulation in field emission displays.

BACKGROUND OF THE INVENTION

Field emission displays are well known in the art. A field emission display includes an anode plate and a cathode plate that define a thin envelope. Typically, the anode plate and cathode plate are thin enough to necessitate some form of a spacer structure to prevent implosion of the device due to the pressure differential between the internal vacuum and external atmospheric pressure. The spacers are disposed within the active area of the device, which includes the electron emitters and phosphors.

The potential difference between the anode plate and the cathode plate is typically within a range of 300–10,000 volts. To withstand the potential difference between the anode plate and the cathode plate, the spacers typically include a dielectric material. Thus, the spacers have dielectric surfaces that are exposed to the evacuated interior of the device.

During the operation of the field emission display, electrons are emitted from electron emitters, such as Spindt tips, at the cathode plate. These electrons traverse the evacuated region and impinge upon the phosphors. Some of these electrons can strike the dielectric surfaces of the spacers. In this manner, the dielectric surfaces of the spacers become charged. Typically, the dielectric spacers become positively charged because the secondary electron yield of the spacer material is initially greater than one.

Numerous problems arise due to the charging of dielectric surfaces within a field emission display. For example, control over the trajectory of electrons adjacent to the spacers is lost. Also, the risk of electrical arcing events increases dramatically.

It is known to use electron current from the electron emitters coupled with a fixed resistance connected between the anode plate and an anode voltage source to reduce the voltage at the anode plate and cause the electrons to be attracted by the charged surfaces. The electrons are used to neutralize the charged surfaces. However, the electrons that pull down the voltage at the anode plate also strike the phosphors, which results in a visible "flash" of light being generated at the viewing screen of the field emission display. Furthermore, the fixed resistance between the anode plate and the anode voltage source necessitates a high current to pull down the anode voltage, which results in large power losses.

Accordingly, there exists a need for a method for reducing charge accumulation in a field emission display, which reduces or eliminates this visible "flash" and which reduces the power loss associated with pulling down the anode voltage.

BRIEF DESCRIPTION OF THE DRAWINGS

Referring to the drawings.

Figure 1:
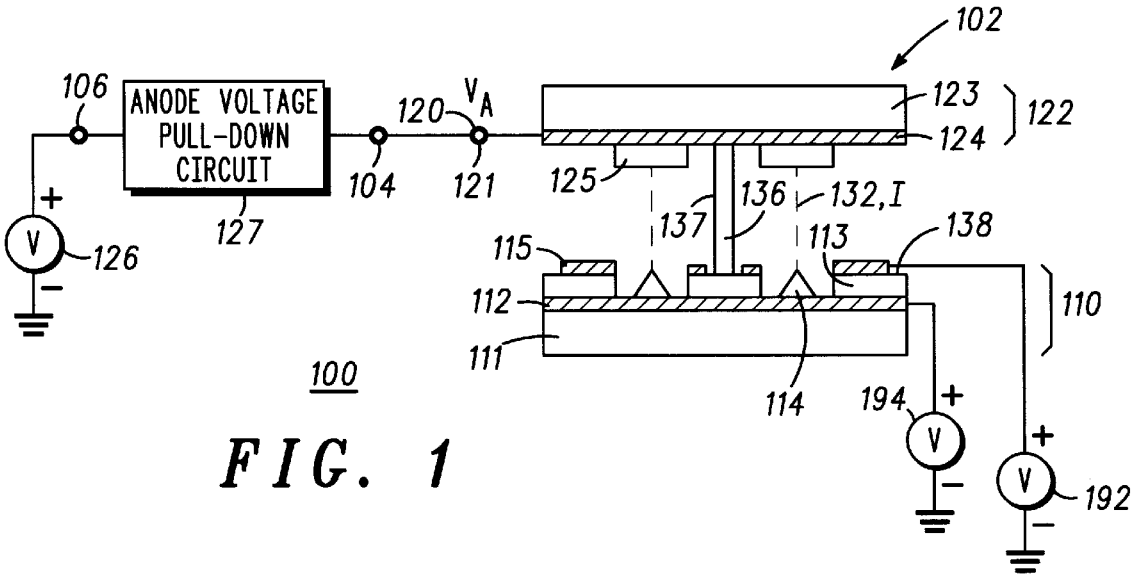
FIG. 1 is a cross-sectional view of a field emission display in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a field emission display having an anode voltage pull-down circuit connected to the anode of the field emission display. The anode voltage pull-down circuit has a discharge mode configuration, which is employed to reduce the potential at the anode. The reduced anode potential allows electrons emitted within the display device to be used to discharge positively electrostatically charged surfaces within the display device. The anode voltage pull-down circuit is particularly useful for anode scanning potentials of greater than 600 volts, preferably greater than 1000 volts, and most preferably greater than 3000 volts.

Preferably, the anode voltage pull-down circuit provides the benefit of reducing or eliminating an electron current that activates the phosphors during the step of reducing the anode voltage. For example, the anode voltage pull-down circuit can include a current source external to the display device. The external current source is connected to the anode for reducing the anode potential in a manner that does not result in activation of the phosphors by electrons from the electron emitters of the display device. This provides the benefit of avoiding generation of an undesirable, visible "flash".

The anode voltage pull-down circuit of the invention further preferably reduces the current used for pulling down the anode voltage. This provides the benefit of reducing the power dissipation associated with reducing the anode voltage.

The method for operating a field emission display in accordance with the invention includes the steps of reducing a potential at the anode and, thereafter, causing a discharge current to be emitted from the electron emitters of the display device. The discharge current is useful for neutralizing positively electrostatically charged surfaces within the display device. The method of the invention avoids generation of a visible "flash" from the display during the step of reducing the anode potential. Furthermore, the step of reducing the anode potential is preferably controlled in order to control the response of the display device and/or the anode power supply.

FIG. 1 is a cross-sectional view of a field emission display 100 in accordance with a preferred embodiment of the invention. Field emission display 100 includes a display device 102 and an anode voltage pull-down circuit 127.

Display device 102 includes a cathode plate 110 and an anode plate 122. Cathode plate 110 and anode plate 122 are spaced apart by a spacer 136. Cathode plate 110 includes a substrate 111, which can be made from glass, silicon, and the like. A plurality of conductive columns 112 is disposed upon substrate 111. A dielectric layer 113 is disposed upon conductive columns 112 and further defines a plurality of wells.

An electron emitter 114 is disposed in each of the wells. Anode plate 122 is disposed to receive an electron current 132, I, emitted by electron emitters 114. A plurality of conductive rows 115 is formed on dielectric layer 113 proximate to the wells. Conductive columns 112 and conductive rows 115 are used to selectively address electron emitters 114.

To facilitate understanding, FIG. 1 depicts only a few rows and one column. However, it is desired to be understood that any number of rows and columns can be employed. An exemplary number of rows for display device 102 is 240, and an exemplary number of columns is 720. Methods for fabricating cathode plates for matrix-addressable field emission displays are known to one of ordinary skill in the art.

Anode plate 122 includes a transparent substrate 123 made from, for example, glass. An anode 124 is disposed on transparent substrate 123. Anode 124 is preferably made from a transparent conductive material, such as indium tin oxide. In the preferred embodiment, anode 124 is a continuous layer that opposes the entire emissive area of cathode plate 110. That is, anode 124 opposes the entirety of electron emitters 114. Anode 124 is designed to be connected to a potential source 126, which is preferably a direct current (D.C.) voltage source. A plurality of phosphors 125 is disposed upon anode 124. Methods for fabricating anode plates for matrix-addressable field emission displays are also known to one of ordinary skill in the art.

An output 104 of anode voltage pull-down circuit 127 is connected to an input 121 of anode 124. An input 106 of anode voltage pull-down circuit 127 is designed to be connected to potential source 126.

Spacers 136 are useful for maintaining a separation distance between cathode plate 110 and anode plate 122. Only one spacer 136 is depicted in FIG. 1. However, the actual number of spacers 136 depends on the structural requirements of display device 102.

Spacers 136 can be made from a dielectric material, a bulk resistive material, or a combination thereof. Spacers 136 can be thin plates, ribs, or any of numerous other shapes. Any dielectric surface defined by spacer 136 can become a positively electrostatically charged surface 137 during the operation of field emission display 100. Other surfaces, such as a surface 138 of dielectric layer 113, within display device 102 can also become positively electrostatically charged during operation of the device. These surfaces become charged because some of the electrons of electron current 132 impinge upon gas molecules that become positively ionized and impact these surfaces. If a surface has a secondary electron yield of greater than one, the surface emits more than one electron for each electron or ion received. Thus, a positive potential is developed. The method of the invention is useful for reducing the charge on these surfaces, while simultaneously improving power requirements, black level, and response of potential source 126 during the steps for reducing the charge.

A voltage source 194 is connected to each of conductive columns 112. Voltage source 194 is useful for applying potentials, as defined by video data, for creating a display image and for reducing charge accumulation in display device 102. A voltage source 192 is connected to each of conductive rows 115. Voltage source 192 is useful for applying potentials for creating a display image and for reducing charge accumulation in display device 102.

The operation of field emission display 100 will now be described with reference to FIG. 1. The operation of field emission display 100 is characterized by two modes of operation: a scanning mode and a discharge mode. During the scanning mode, potentials are sequentially applied to conductive rows 115. By scanning it is meant that a potential suitable for causing electron emission is selectively applied to the scanned row. Whether each of electron emitters 114 within a scanned row is caused to emit electrons depends upon the video data and the voltage applied to each column. Electron emitters 114 in the rows not being scanned are not caused to emit electrons. During the time that one of conductive rows 115 is scanned, potentials are applied to conductive columns 112 according to video data.

During the scanning mode, an anode voltage 120, $V_A$, which is the potential at anode 124, is selected to attract electron current 132 toward anode plate 122 and to provide a desired level of brightness of the image generated by phosphors 125. Anode voltage 120 is provided by potential source 126. In accordance with the invention, during the scanning mode, anode voltage 120 is held at some value, $V_S$, which is preferably greater than 600 volts, more preferably greater than 1000 volts, and most preferably greater than 3000 volts.

During the scanning mode, most of the electrons emitted by electron emitters 114 strike anode plate 122. However, some of the emitted electrons impinge upon dielectric surfaces within display device 102, causing the dielectric surfaces to become positively electrostatically charged. The charged surfaces cause undesirable effects, such as adversely affecting the control of electron current 132.

To achieve the discharge mode of operation of field emission display 100, and in accordance with the invention, anode voltage 120 is reduced from a scanning mode value, $V_S$, to a discharge mode value, $V_D$, and electron current 132 is increased from a scanning mode value, $I_S$, to a discharge mode value, $I_D$. The discharge mode value, $I_D$, of electron current 132 is useful for neutralizing positively electrostatically charged surfaces within display device 102. Anode voltage 120 is reduced by an amount sufficient to allow electron current 132 to be directed toward the charged surfaces. Preferably, anode voltage 120 is reduced to about ground potential. Anode voltage pull-down circuit 127 is useful for reducing anode voltage 120 during the discharge mode of operation.

The discharge current, $I_D$, is preferably generated by causing the entirety of electron emitters 114 to emit electrons. This is achieved by applying the appropriate emission/"on" potentials to all of rows 115 and columns 112 of cathode plate 110. Thus, the discharge current available for neutralization is equal to the product of the total number of rows 115 and the maximum emission current per row 115. The discharge current can also be generated by causing less than all of electron emitters 114 to emit electrons.

In the preferred embodiment, the pull-down and discharge steps occur at the end of a display frame, subsequent to one scanning cycle. However, other suitable timing schemes can be employed. For example, the discharge mode can occur after multiple display frames have been executed.

Figure 2:
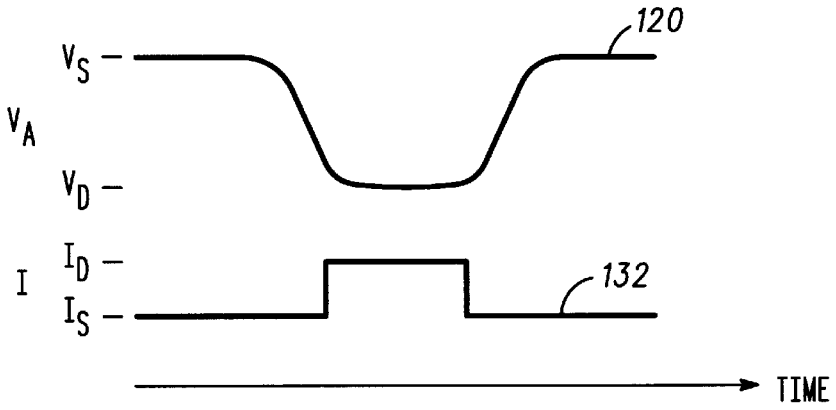
FIG. 2 is a timing diagram illustrating a method for operating a field emission display in accordance with the invention.

FIG. 2 is a timing diagram illustrating a method for operating field emission display 100 in accordance with the invention. FIG. 2 illustrates a preferred embodiment of a method for operating field emission display 100 in accordance with the invention. As illustrated in FIG. 2, the discharge mode of operation includes the step of reducing anode voltage 120 from a scanning mode value, $V_S$, to a discharge mode value, $V_D$. After anode voltage 120 has been reduced, electron current 132 is increased from a scanning mode value, $I_S$, to a discharge mode value, $I_D$. Preferably, electron current 132 is increased when anode voltage 120 is equal to, or nearly equal to, $V_D$.

Figure 3:
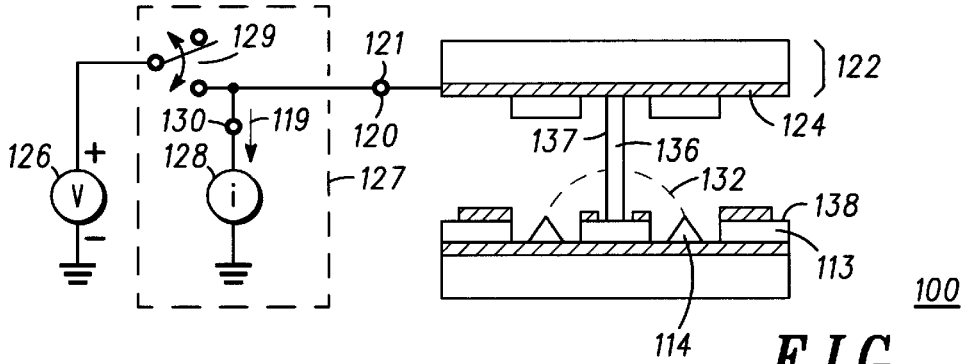
FIGS. 3 and 4 are circuit diagrams of a field emission display having an anode voltage pull-down circuit in accordance with the preferred embodiment of the invention.
Figure 4:
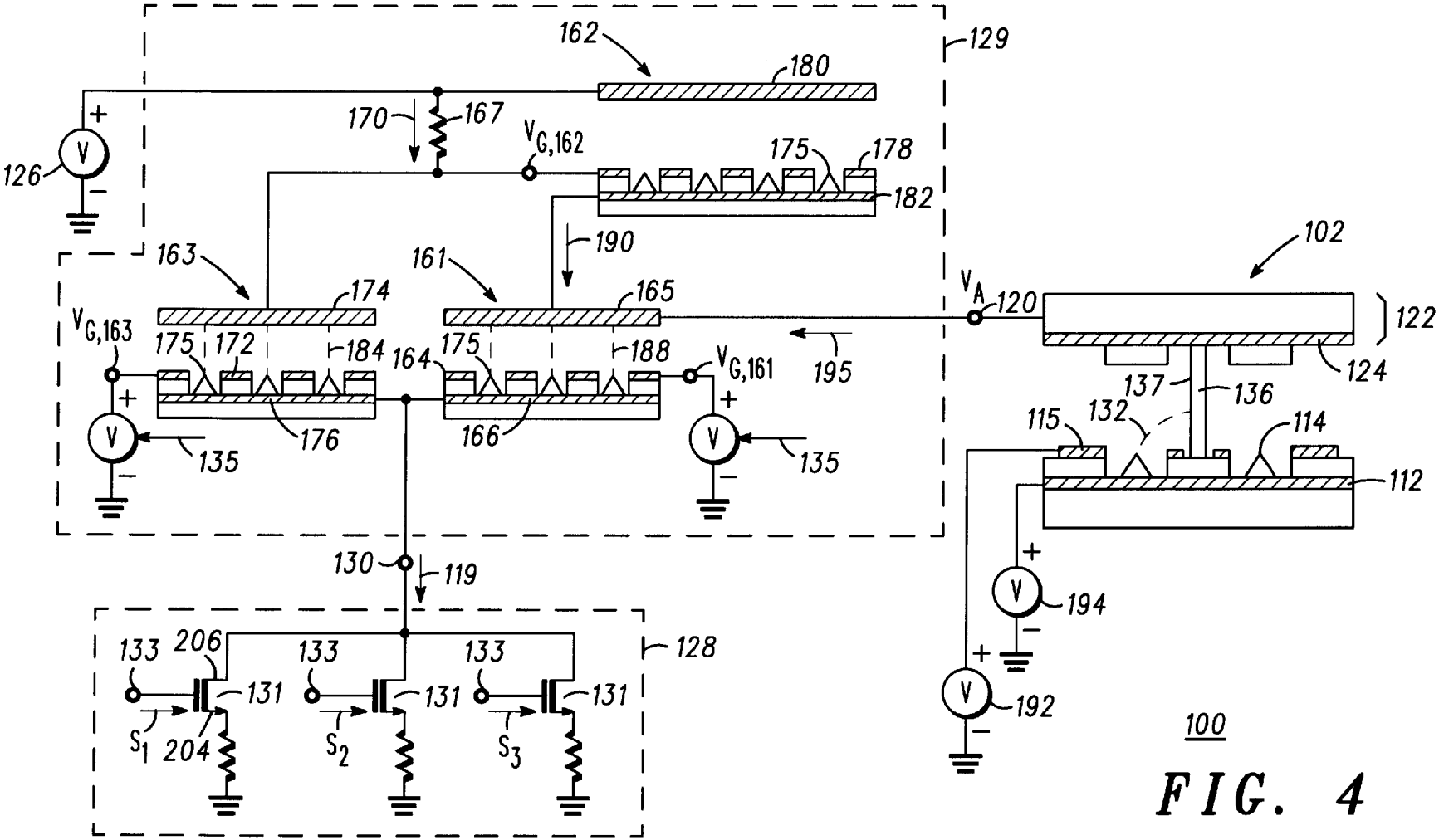

FIGS. 3 and 4 are circuit diagrams of field emission display 100 having anode voltage pull-down circuit 127 in accordance with the preferred embodiment of the invention. In the embodiment of FIG. 3, anode voltage pull-down circuit 127 includes a variable current source 128. Variable current source 128 has an input 130 connected to input 121 of anode 124. Input 130 of variable current source 128 is also designed to be connected to potential source 126. In the preferred embodiment of FIG. 3, anode voltage pull-down circuit 127 further comprises a switch 129 configured to allow disconnection of potential source 126 from anode 124 without causing disconnection of variable current source 128 from anode 124.

In general, a switch element of an anode voltage pull-down circuit that embodies the invention can be implemented in many ways. For high speed switching, a bank of transistors can be used. When high switching speed is not necessary, a mechanical switch can be used. Other switches, such as a mercury switch or a vacuum device switch, can also be useful.

Anode voltage pull-down circuit 127 is characterized by a scanning mode configuration and a discharge mode configuration. The scanning mode configuration is the configuration of anode voltage pull-down circuit 127 during the scanning mode of operation of field emission display 100; the discharge mode configuration is the configuration of anode voltage pull-down circuit 127 during the discharge mode of operation of field emission display 100.

In the embodiment of FIG. 3, the scanning mode configuration of anode voltage pull-down circuit 127 is characterized by switch 129 being closed and no anode voltage pull-down current 119 being drawn by variable current source 128. The discharge mode configuration is characterized by switch 129 being open and anode voltage pull-down current 119 flowing into input 130 of variable current source 128. Anode voltage pull-down current 119 is useful for reducing anode voltage 120.

FIG. 4 is a circuit diagram of field emission display 100 in accordance with the preferred embodiment of the invention. In the embodiment of FIG. 4, switch 129 includes a first field emission device 163, a second field emission device 162, a third field emission device 161, and a pull-up resistor 167. Each of field emission devices 163, 162, and 161 has a plurality of electron emitters 175, which can be Spindt tips. The gates and cathodes within each device of switch 129 are configured to provide simultaneous emission of electron emitters 175 upon activation of the device.

A cathode 176 of first field emission device 163 and a cathode 166 of third field emission device 161 are connected to input 130 of variable current source 128. An anode 174 of first field emission device 163 is connected to a gate 178 of second field emission device 162. An anode 180 of second field emission device 162 is designed to be connected to potential source 126. A cathode 182 of second field emission device 162 is connected to an anode 165 of third field emission device 161. Anode 165 of third field emission device 161 is also connected to anode 124 of anode plate 122. Pull-up resistor 167 extends between anode 180 of second field emission device 162 and anode 174 of first field emission device 163.

As further illustrated in FIG. 4, variable current source 128 of the preferred embodiment includes a plurality of field effect transistors 131. Field effect transistors 131 are connected at their drains 206 in the manner shown in FIG. 4. A source 204 of each of field effect transistors 131 is connected to ground. Input 130 of variable current source 128 is connected to drain 206 of the first in the series of field effect transistors 131.

Each of field effect transistors 131 has an input 133 connected to its gate. A signal is applied to input 133 to activate the transistor and thereby contribute to anode voltage pull-down current 119. As illustrated in FIG. 4, a signal, $S_1$, is applied to input 133 of the first of field effect transistors 131; a signal, $S_2$, is a applied to input 133 of the second in the series of field effect transistors 131; and a signal, $S_3$, is applied to input 133 of the third in the series of field effect transistors 131. Fewer than or more than three field effect transistors can be employed. The number of field effect transistors 131 is selected, in part, to provide the desired rate of decrease of anode voltage 120.

Figure 5:
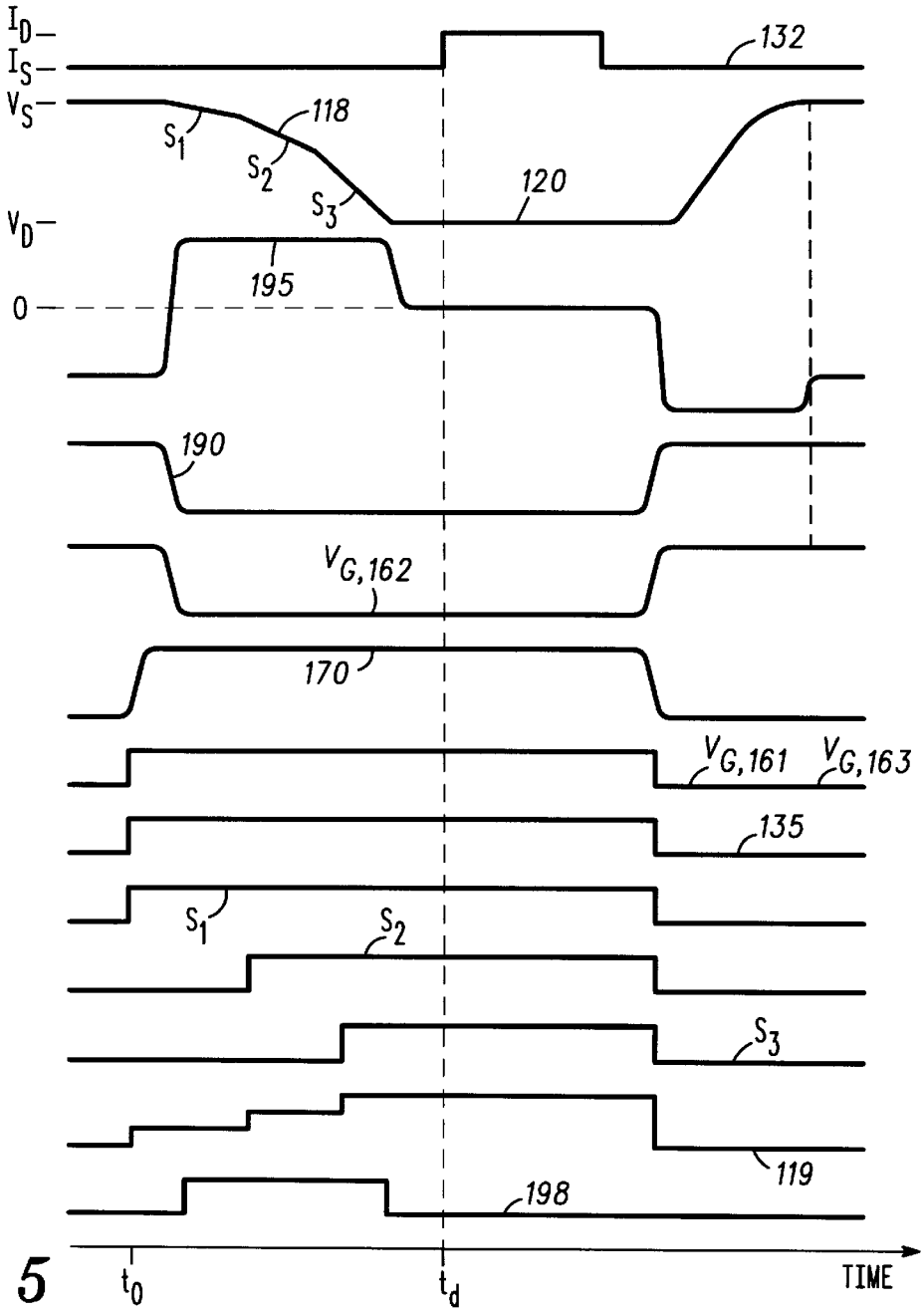
FIG. 5 is a timing diagram illustrating a method for operating a field emission display in accordance with the invention.

FIG. 5 is a timing diagram illustrating a method for operating field emission display 100 of FIG. 4 in accordance with the invention. During the scanning mode configuration of anode voltage pull-down circuit 127 of the embodiment of FIG. 4, electron emitters 175 of first and third field emission devices 163 and 161 do not emit. During the scanning mode configuration, electron emitters 175 of second field emission device 162 do emit electrons, and variable current source 128 is not activated. Furthermore, no anode voltage pull-down current 119 flows into input 130 of variable current source 128. Also, a current 190 flows from cathode 182 to anode 165 to sustain anode voltage 120 during the scanning mode of operation of display device 102. Additionally, a voltage at gate 178, $V_{G,162}$, is high, for causing electron emission in second field emission device 162; the voltages at gates 164 and 172, $V_{G,161}$ and $V_{G,163}$, are low to prevent emission in first and third field emission devices 163 and 161.

As further illustrated in FIG. 5, during the discharge mode configuration of anode voltage pull-down circuit 127, a control signal 135 is applied at time $t_0$ to voltage sources for activating electron currents 184 and 188 from electron emitters 175 of first and third field emission devices 163 and 161, respectively. For example, the voltages at gates 164 and 172, $V_{G,161}$ and $V_{G,163}$, can be increased as illustrated in FIG. 5. This generates a current 170 through pull-up resistor 167, thereby decreasing the voltage at gate 178, $V_{G,162}$. The drop in $V_{G,162}$ ceases emission in second field emission device 162 and reduces current 190. The emission at third field emission device 161 causes a current 195 to flow from anode 124 of display device 102 toward anode 165 of third field emission device 161, thereby reducing anode voltage 120.

In accordance with the invention, the rate of reduction of anode voltage 120 is controlled to control the response of potential source 126 and display device 102 to the pull-down process. For example, if the pull-down rate is too high, the output of potential source 126 can become oscillatory or erratic. Furthermore, an uncontrolled pull-down rate can cause anode plate 122 and cathode plate 110 to vibrate, potentially causing audible mechanical vibrations.

In the embodiment of FIGS. 4 and 5, the rate of reduction of anode voltage 120 is controlled by sequentially activating field effect transistors 131 during the pull-down step. Initially, only signal, $S_1$, is applied to input 133 of the first of field effect transistors 131. Thereafter, $S_2$, is applied to input 133 of the second of field effect transistors 131, and so on. In this manner, anode voltage pull-down current 119 can be controllably increased. The rate of reduction of anode voltage 120 is thus controllably increased, as indicated by a pull-down portion 118 of graph 120 in FIG. 5.

When anode voltage 120 is reduced sufficiently, at time $t_d$, the discharge current, $I_D$, is generated within display device 102. Thereafter, the discharge current, $I_D$, is terminated, and anode voltage 120 is returned to its scanning mode value, $V_S$.

This is achieved by deactivating variable current source 128 and further deactivating first and third field emission devices 163 and 161. Current 170 through pull-up resistor 167 drops, causing the voltage at gate 178, $V_{G,162}$, to rise. Electron emitters 175 of second field emission device 162 are caused to emit, and current 190 flows from cathode 182 to anode 165. Current 195 flows from anode 165 to anode 124 to first charge up the capacitance of display device 102 and then maintain anode voltage 120 at its scanning value.

Figure 6:
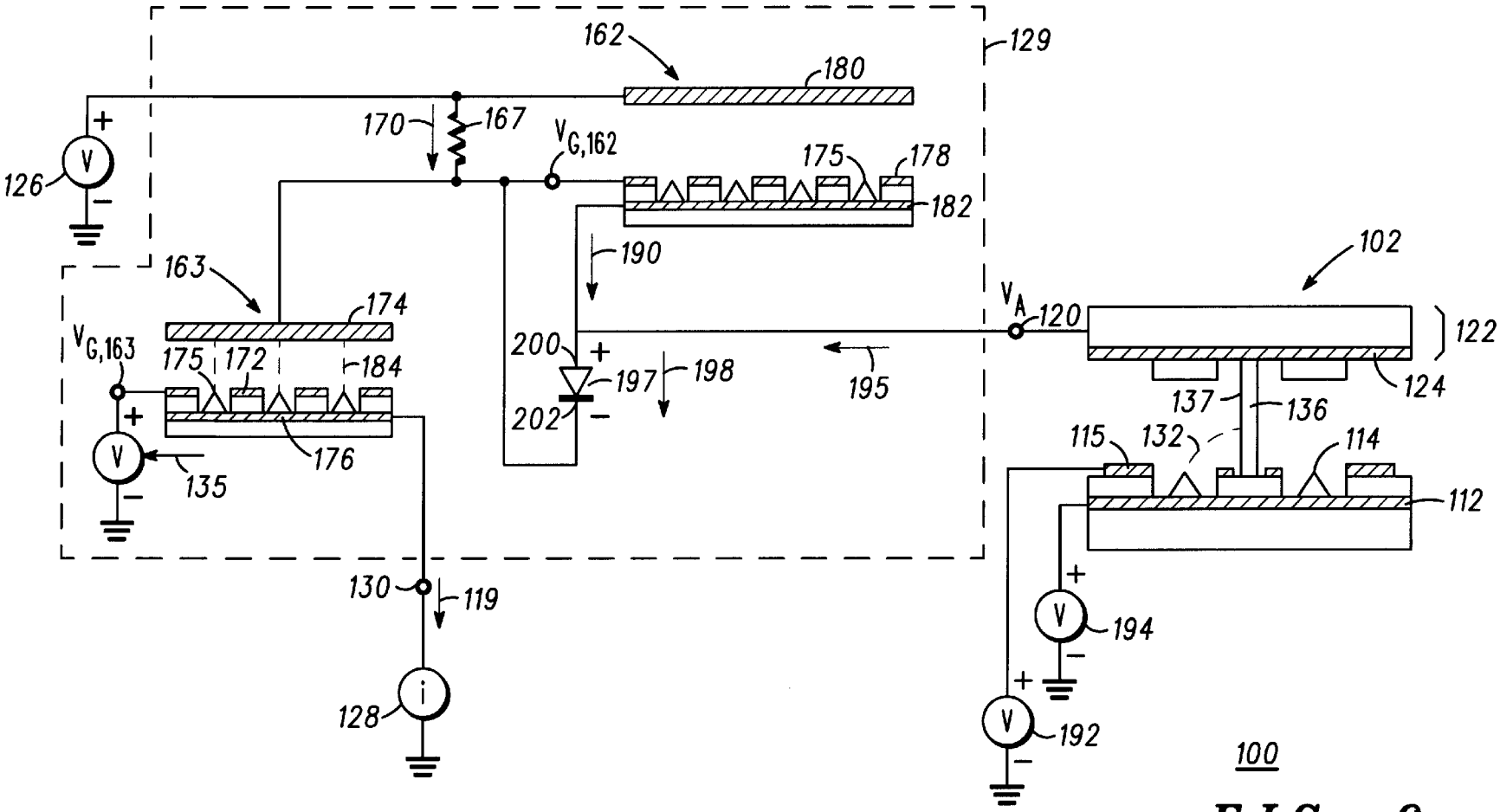
FIG. 6 is a circuit diagram of a field emission display having an anode voltage pull-down circuit in accordance with another embodiment of the invention.

FIG. 6 is a circuit diagram of field emission display 100 in accordance with another embodiment of the invention. In the embodiment of FIG. 6, a diode 197 is substituted for third field emission device 161 of switch 129. Diode 197 has an anode 200, which is connected to cathode 182 of second field emission device 162 and is further connected to anode 124 of anode plate 122. Diode 197 also has a cathode 202, which is connected to anode 174 of first field emission device 163.

In the operation of the embodiment of FIG. 6, first field emission device 163 is activated by control signal 135 and variable current source 128 is activated in the manner described with reference to FIGS. 4 and 5. The emission at first field emission device 163 pulls down the voltage at gate 178 and terminates emission within second field emission device 162. This causes the voltage at cathode 202 of diode 197 to drop sufficiently to allow a current 198 to flow through diode 197. Current 198 is also represented in FIG. 5. The activation of current 198 allows the discharge of anode 124. The rate of reduction of anode voltage 120 is provided in the manner described with reference to FIGS. 4 and 5.

Figure 7:
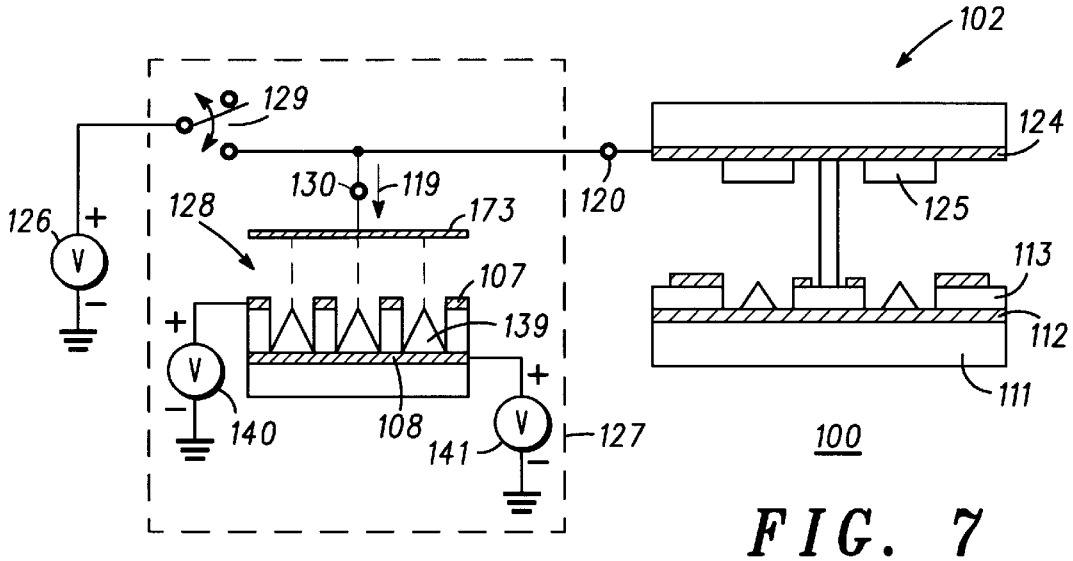
FIG 7 is a circuit diagram of a field emission display having an anode voltage pull-down circuit in accordance with still another embodiment of the invention.

FIG. 7 is a circuit diagram of field emission display 100 having anode voltage pull-down circuit 127 in accordance with still another embodiment of the invention. In the embodiment of FIG. 7, variable current source 128 includes a field emission device having an anode 173, a plurality of rows 107, and a plurality of columns 108. A voltage source 140 is connected to each of rows 107, and a voltage source 141 is connected to each of columns 108. Voltage sources 140 and 141 are useful for selectively addressing a plurality of electron emitters 139 to control anode voltage pull-down current 119. Input 130 of variable current source 128 is connected to anode 173 of the field emission device.

In the embodiment of FIG. 7, the scanning mode configuration of anode voltage pull-down circuit 127 is characterized by non-activation of the field emission device of variable current source 128 and is further characterized by switch 129 being closed. The discharge mode configuration is characterized by activation of the field emission device of variable current source 128, so that anode voltage pull-down current 119 flows into input 130, resulting in the discharge of anode 124 of display device 102. The discharge mode configuration is also characterized by switch 129 being open. After anode voltage 120 has been reduced sufficiently, a discharge current is provided by electron current 132 for neutralizing positively electrostatically charged surfaces within display device 102.

The field emission device of variable current source 128 is illustrated in FIG. 7 as being separate from display device 102. However, it is desired to be understood that the field emission device of variable current source 128 can be an integral part of display device 102.

Figure 8:
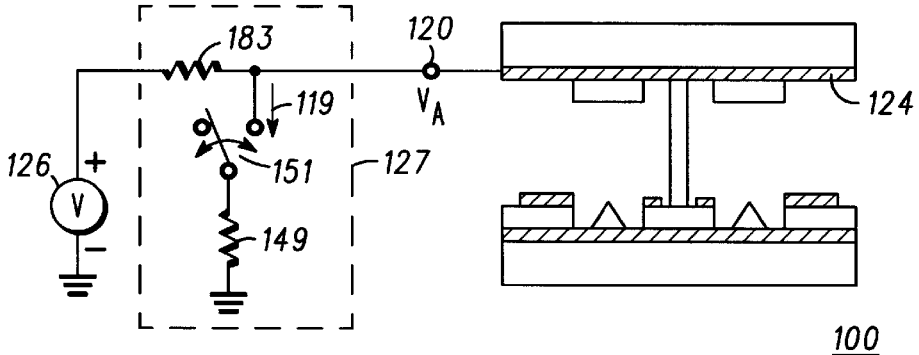
FIG. 8 is a circuit diagram of a field emission display having an anode voltage pull-down circuit having a shunt resistor in accordance with yet another embodiment of the invention.

FIG. 8 is a circuit diagram of field emission display 100 having anode voltage pull-down circuit 127 in accordance with yet another embodiment of the invention. In the embodiment of FIG. 8, anode voltage pull-down circuit 127 includes a shunt resistor 149. Shunt resistor 149 is used for discharging anode 124 of display device 102 during the discharge mode of operation of field emission display 100. Shunt resistor is designed to be connected to anode 124, so that anode voltage pull-down current 119 can flow from anode 124 to electrical ground.

In the embodiment of FIG. 8, anode voltage pull-down circuit 127 further includes a resistor 183 connected to potential source 126 and a switch 151, which is configured to allow disconnection of shunt resistor 149 from anode 124 without causing disconnection of potential source 126 from anode 124. The scanning mode configuration of anode voltage pull-down circuit 127 of the embodiment of FIG. 8 is characterized by switch 151 being open; the discharge mode configuration is characterized by switch 151 being closed. Subsequent to the pull-down of anode voltage 120, a discharge current is provided by electron current 132 for neutralizing positively electrostatically charged surfaces within field emission display 100.

Figure 9:
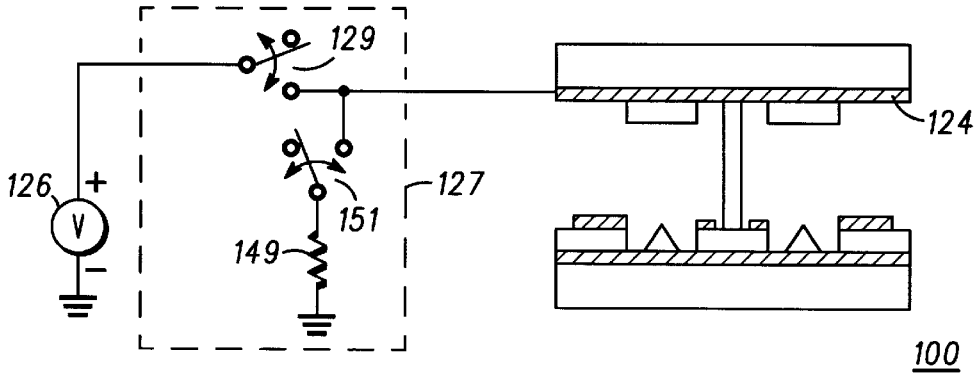
FIG. 9 is a circuit diagram of a field emission display having an anode voltage pull-down circuit having a shunt resistor in accordance with a further embodiment of the invention.

FIG. 9 is a circuit diagram of field emission display 100 having anode voltage pull-down circuit 127 in accordance with a further embodiment of the invention. The embodiment of FIG. 9 is similar to the embodiment of FIG. 8 and further includes switch 129. Switch 129 is configured to allow disconnection of potential source 126 from anode 124 without causing disconnection of shunt resistor 149 from anode 124. The scanning mode configuration is further characterized by switch 129 being closed, and the discharge mode configuration is further characterized by switch 129 being open.

Figure 10:
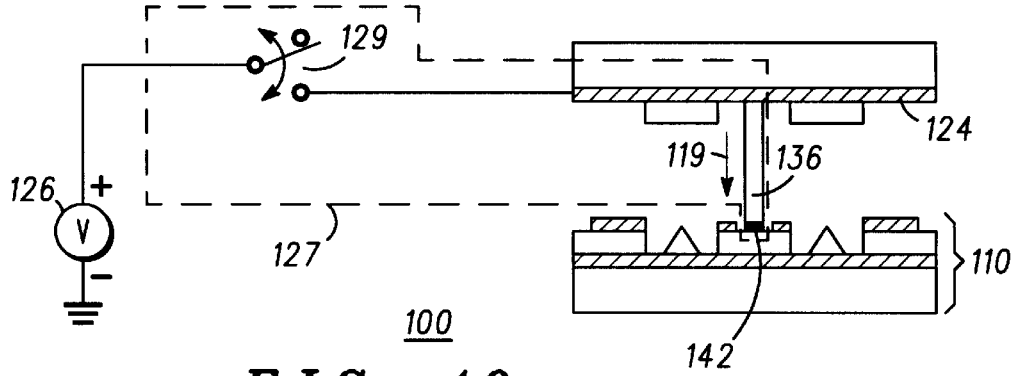
FIG. 10 is a circuit diagram of a field emission display having an anode voltage pull-down circuit in which a display spacer functions as a shunt resistor in accordance with still a further embodiment of the invention.

FIG. 10 is a circuit diagram of field emission display 100 having anode voltage pull-down circuit 127 in accordance with still a further embodiment of the invention. In the embodiment of FIG. 10, spacer 136 of display device 102 functions as a shunt resistor. The discharge mode configuration of anode voltage pull-down circuit 127 of the embodiment of FIG. 10 is characterized by switch 129 being open. To discharge anode 124, anode voltage pull-down current 119 flows from anode 124 to cathode plate 110 through spacer 136. The potential at spacer 136 can be controlled by providing a conductive layer 142, which is disposed on cathode plate 110 and is connected to spacer 136. To achieve the desired anode voltage pull-down current 119, spacer 136 is made from a convenient bulk-resistive material.

Figure 11:
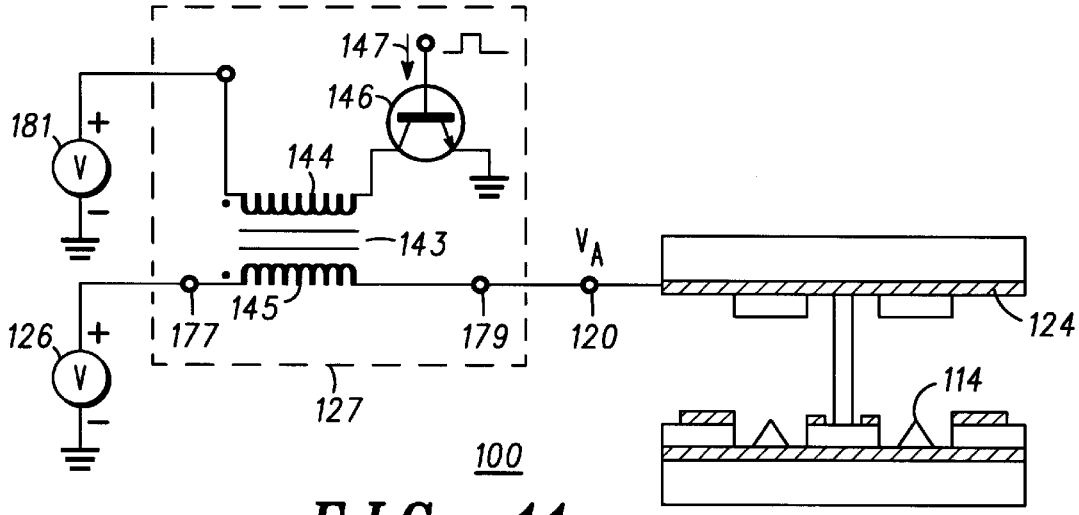
FIG. 11 is a circuit diagram of a field emission display having an anode voltage pull-down circuit having a transformer in accordance with yet a further embodiment of the invention.

FIG. 11 is a circuit diagram of field emission display 100 having anode voltage pull-down circuit 127 in accordance with yet a further embodiment of the invention. In the embodiment of FIG. 11, anode voltage pull-down circuit 127 includes a transformer 143. Preferably, transformer 143 is a photo-flash, trigger-type pulse transformer. However, other types of transformers can be employed. As illustrated in FIG. 11, transformer 143 has a primary coil 144 and a secondary coil 145. Transformer 143 is connected to a drive circuit that fires transformer 143 during the discharge mode of operation of field emission display 100.

The firing of transformer 143 causes a voltage pulse of polarity opposite that of potential source 126 to be applied by secondary coil 145. In the embodiment of FIG. 11, the drive circuit, which is useful for firing transformer 143, includes a bipolar transistor 146. The collector of bipolar transistor 146 is connected to a first terminal of primary coil 144. The emitter of bipolar transistor 146 is connected to ground.

Bipolar transistor 146 is activated by the application of an electrical pulse 147 to its base. Electrical pulse 147 can be a voltage pulse or a current pulse. Activating bipolar transistor 146 causes the first terminal of primary coil 144 to become grounded. A potential source 181 provides a potential at a second terminal of primary coil 144. Thus, when bipolar transistor 146 is activated, a voltage drop is realized between the second and first terminals of primary coil 144. Primary coil 144 is driven in this manner for the discharge mode configuration of anode voltage pull-down circuit 127 of the embodiment of FIG. 11.

The scanning mode configuration is characterized by bipolar transistor 146 not being activated, so that little or no voltage drop exists over primary coil 144. Primary coil 144 is thus not driven for the scanning mode configuration of anode voltage pull-down circuit 127 of the embodiment of FIG. 11.

Secondary coil 145 has an input 177 designed to be connected to potential source 126 and an output 179, which is connected to anode 124. During the discharge mode, transformer 143 applies an opposing voltage pulse sufficient to cause anode voltage 120 to drop to about ground potential. While anode voltage 120 is low, a discharge current is provided by electron emitters 114 for neutralizing positively electrostatically charged surfaces within field emission display 100.

Figure 12:
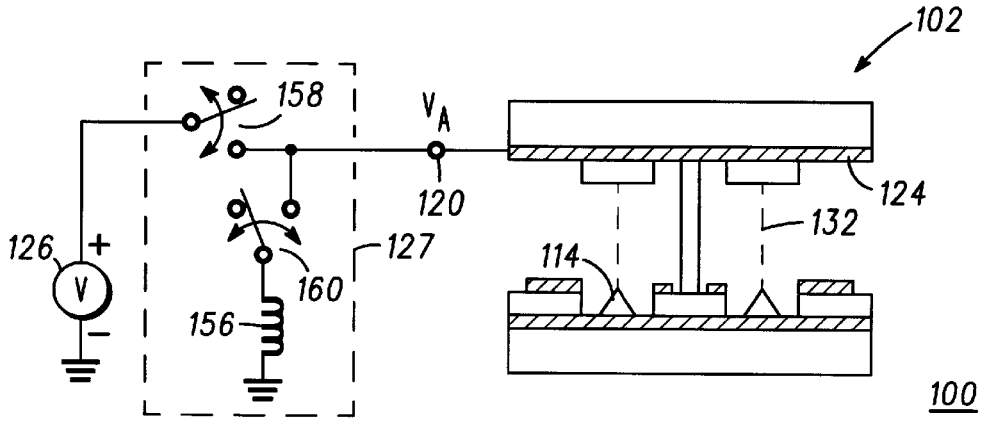
FIG. 12 is a circuit diagram of a field emission display having an anode voltage pull-down circuit having a tank circuit configuration in accordance with even another embodiment of the invention.

FIG. 12 is a circuit diagram of field emission display 100 having anode voltage pull-down circuit 127 in accordance with even another embodiment of the invention. In the embodiment of FIG. 12, anode voltage pull-down circuit 127 functions in a manner similar to a tank circuit and includes an inductor 156. Inductor 156 is designed to be connected to anode 124. Anode voltage pull-down circuit 127 of the embodiment of FIG. 12 further includes a first switch 160, which is configured to allow disconnection of inductor 156 from anode 124 without causing disconnection of potential source 126 from anode 124. Anode voltage pull-down circuit 127 of the embodiment of FIG. 12 further includes a second switch 158 configured to allow disconnection of potential source 126 from anode 124 without causing disconnection of inductor 156 from anode 124.

The discharge mode configuration of anode voltage pull-down circuit 127 of the embodiment of FIG. 12 is characterized by first switch 160 being closed and second switch 158 being open. In this configuration, display device 102 behaves like a capacitor. The behavior of the circuit formed by anode voltage pull-down circuit 127 and display device 102 during the discharge mode configuration is similar to that of a tank circuit. That is, electrical charge is transferred back and forth between anode 124 and inductor 156. The frequency of the charge transfer oscillations is determined by the inductance of inductor 156 and the capacitance of display device 102.

Figure 13:
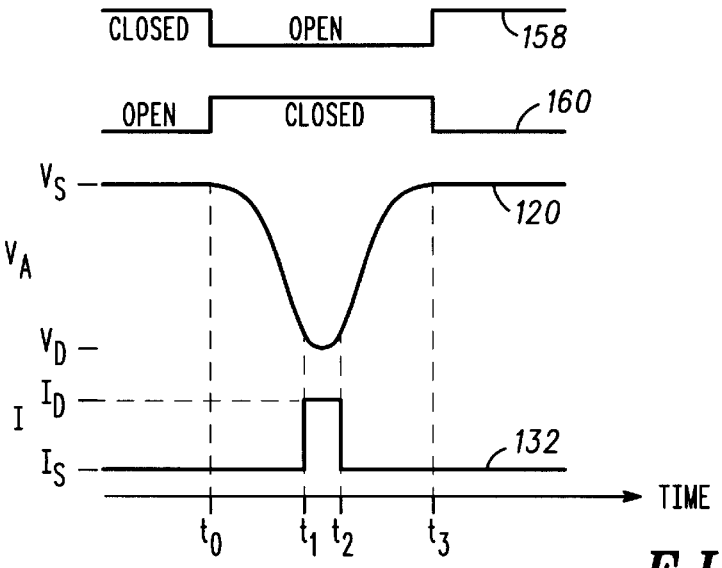
FIG. 13 is a timing diagram of the operation of the embodiment of FIG. 12.
Figure 15:
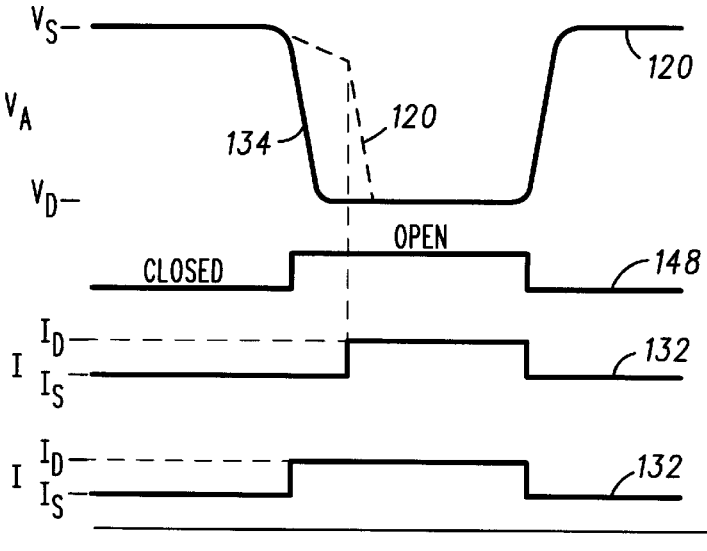
FIG. 15 is a timing diagram of the operation of the embodiment of FIG. 14.

FIG. 15 is a timing diagram illustrating the operation of the embodiment of FIG. 12. As illustrated in FIG. 13, time $t_0$ represents the commencement of the discharge mode of operation of field emission display 100. Prior to time $t_0$, during the scanning mode of operation, second switch 158 is closed and first switch 160 is open, allowing anode voltage 120, $V_A$, to be maintained at its scanning mode value, $V_S$, by potential source 126.

At time $t_0$, second switch 158 is opened and first switch 160 is closed. Then, the electrical charge transfer between anode 124 and inductor 156 commences. The result is a sinusoidal response of anode voltage 120, as illustrated in FIG. 13. Anode voltage 120 drops from its scanning mode value, $V_S$, to a discharge mode value, $V_D$. When anode voltage 120 is at or near the discharge mode value, a discharge current, $I_D$, is caused to be emitted by electron emitters 114. As illustrated in FIG. 13, the discharge current is provided between times $t_1$ and $t_2$, while anode voltage 120 is low. At time $t_3$l when anode voltage 120 returns to its maximum value, first switch 160 is opened and second switch 158 is closed, and the oscillation of anode voltage 120 ceases.

Figure 14:
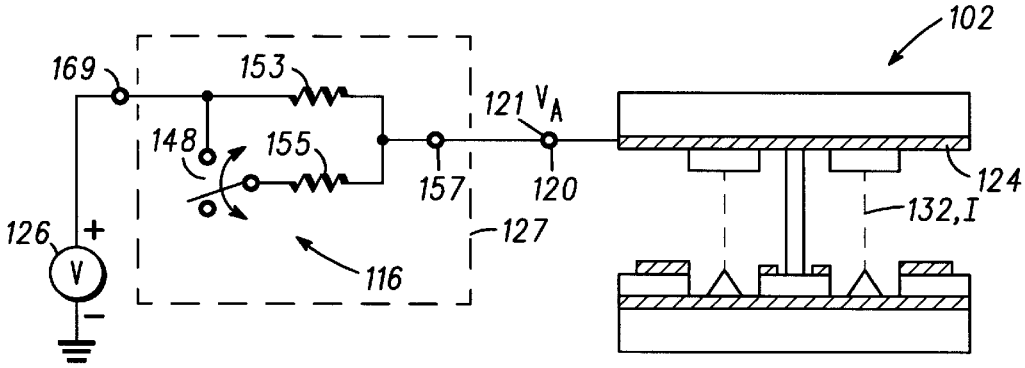
FIG. 14 is a circuit diagram of a field emission display having an anode voltage pull-down circuit including a variable resistance circuit in accordance with even still another embodiment of the invention.

FIG. 14 is a circuit diagram of field emission display 100 having anode voltage pull-down circuit 127 in accordance with even still another embodiment of the invention. In the embodiment of FIG. 14, anode voltage pull-down circuit 127 includes a variable resistance circuit 116, which has an output 157 connected to input 121 of anode 124, and further has an input 169 designed to be connected to potential source 126.

Variable resistance circuit 116 is designed to provide a first resistance during the scanning mode of operation of field emission display 100 and a second resistance during the discharge mode of operation of field emission display 100. In accordance with the invention, the first resistance is lower than the second resistance. The scope of the invention is not limited to the configuration of circuit elements illustrated in FIG. 14 for providing the variable resistance. The increased resistance during the discharge mode of operation is useful for decreasing anode voltage 120. The higher second resistance further provides the benefit of a level of power dissipation that is less than that realized for the same voltage drop achieved by increasing a current across the first resistance.

In the embodiment of FIG. 14, variable resistance circuit 116 includes first and second resistors 153 and 155, which are connected in parallel, and further includes a switch 148. The resistance of first resistor 153 is greater than the resistance of second resistor 155. Switch 148 is configured to prevent current flow through second resistor 155 without preventing current flow through first resistor 153 when switch 148 is open.

As described above, switch 148 can be implemented in many ways. For high speed switching, a bank of transistors can be used. When high switching speed is not necessary, a mechanical switch can be used. Other switches, such as a mercury switch or a vacuum device switch, can also be useful for implementing switch 148.

The scanning mode configuration of variable resistance circuit 116 is characterized by switch 148 being closed, so that the resistance provided by variable resistance circuit 116 is a first value. The discharge mode configuration of variable resistance circuit 116 is characterized by switch 148 being open, so that the resistance provided by variable resistance circuit 116 is a second value, which is higher than the first value.

FIG. 15 is a timing diagram illustrating the operation of the embodiment of FIG. 14. As depicted in FIG. 15, during the discharge mode of operation, switch 148 is open.

As illustrated in an upper graph 132 in FIG. 15, electron current 132 can be allowed to retain its scanning mode value, $I_S$, for a short time after switch 148 is opened. As illustrated by a dashed line for graph 120 in FIG. 15, this allows anode voltage 120 to drop prior to generating the discharge current, $I_D$. Thereafter, the discharge current, $I_D$, is generated by electron emitters 114 for pulling anode voltage 120 down to ground potential and for neutralizing positively electrostatically charged surfaces within field emission display 100. In this manner, anode voltage 120 is controllably reduced.

Another benefit is derived from delaying the discharge current, $I_D$, until anode voltage 120 has been reduced somewhat from its scanning mode value, $V_S$. That is, at the reduced value of anode voltage 120, the energy of the discharge current upon arrival at phosphors 125 is less than the energy it would have had at the scanning mode value, $V_S$. The less energetic discharge current reduces the extent of visible "flashing" from display device 102 during the discharge mode of operation of field emission display 100.

Alternatively, as illustrated by the lower graph 132 in FIG. 15, the discharge current can be generated at about the same time that switch 148 is opened. As depicted by the solid line, pull-down portion 134 of graph 120, the rate of decrease of anode voltage 120 is high, thereby decreasing the amount of time required to pull down anode voltage 120. The high pull-down rate is achieved by simultaneously providing increased resistance via anode voltage pull-down circuit 127 and increased current via the discharge current.

Figure 16:
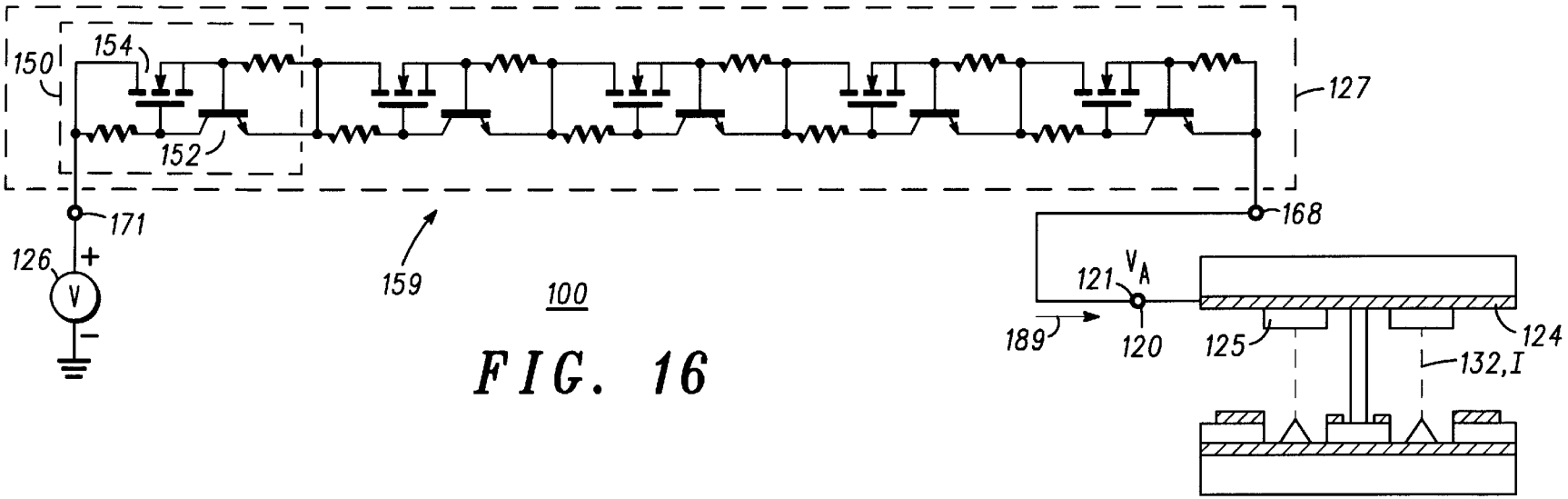
FIG. 16 is a circuit diagram of a field emission display having an anode voltage pull-down circuit including a current-limiter circuit in accordance with even a further embodiment of the invention.

FIG. 16 is a circuit diagram of field emission display 100 having anode voltage pull-down circuit 127 in accordance with even a further embodiment of the invention. In the embodiment of FIG. 16, anode voltage pull-down circuit 127 includes a variable impedance circuit 159. An output 168 of variable impedance circuit 159 is connected to anode 124 of display device 102, and an input 171 of variable impedance circuit 159 is designed to be connected to potential source 126.

Variable impedance circuit 159 is designed to provide a first impedance during a scanning mode of operation of field emission display 100, and a second impedance during a discharge mode of operation of field emission display 100. In accordance with the invention, the first impedance is lower than the second impedance. The scope of the invention is not limited to the configuration of circuit elements illustrated in FIG. 16 for providing the variable impedance.

In the embodiment of FIG. 16, variable impedance circuit 159 includes a current-limiter circuit. The impedance provided by the current-limiter circuit of FIG. 16 is responsive to an anode current 189 drawn by anode 124.

The current-limiter circuit of the embodiment of FIG. 16 includes a plurality of stages 150 connected in series. Each of stages 150 includes an NPN bipolar junction transistor (NPN BJT) 152 and an N-channel metal oxide semiconductor field-effect transistor (N-channel MOSFET) 154, which are connected in the manner shown in FIG. 16.

The number of stages 150 for use in the current-limiter circuit is given by the quotient of $V_S$, which is the value of anode voltage 120 during the scanning mode of operation, and BVdss, which is the breakdown voltage for the drain-to-source junction of N-channel MOSFET 154. For example, for $V_S$ equal to 4000 volts and BVdss equal to 800 volts, the number of stages 150 is five.

Figure 17:
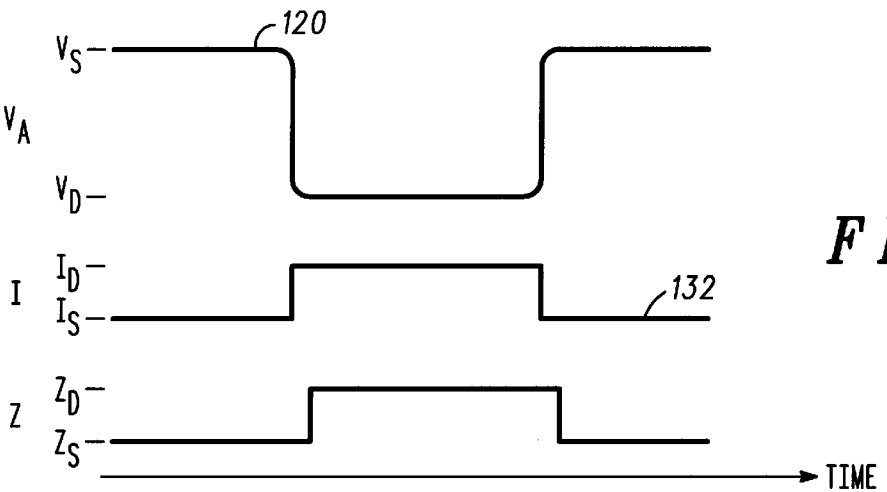
FIG. 17 is a timing diagram of the operation of the embodiment of FIG. 16.

FIG. 17 is a timing diagram of the operation of the embodiment of FIG. 16. The impedance, Z, of the current-limiter circuit is determined, in part, by the value of anode current 189 being pulled from the current-limiter circuit. Specifically, the impedance is determined by the product, P, of anode current 189 and the resistance of the base-to-emitter junction of NPN BJT 152.

When P is less than the voltage, Vbe(on), required across the base-to-emitter junction to turn on NPN BJT 152, the current-limiter circuit operates at a low impedance. In the low impedance state, NPN BJT 152 is off, and N-channel MOSFET 154 is on. When P is greater than Vbe(on), NPN BJT 152 turns on, causing N-channel MOSFET 154 to turn off, so that the current-limiter circuit operates at higher impedances. The increased impedance is useful for pulling down anode voltage 120.

The resistance of the base-to-emitter junction of NPN BJT 152 and Vbe(on) are thus selected to provide the desired response of anode voltage 120. That is, these variables are selected so that the current-limiter circuit operates at a low impedance, $Z_S$, when electron current 132 has the scanning value, $I_S$, to maintain anode voltage 120 at the scanning value, $V_S$. They are further selected so that the current-limiter circuit provides a high impedance, $Z_D$, when electron current 132 has the discharge value, $I_D$, to pull down anode voltage 120 to the discharge value, $V_D$.

In an alternative embodiment, a variable current source is provided between variable impedance circuit 159 and anode 124 of FIG. 16. In this alternative embodiment, the input of the variable current source is connected to output 168 of variable impedance circuit 159 and to input 121 of anode 124, in a manner similar to that of variable current source 128 of FIG. 3.

In this alternative embodiment, the variable current source provides a current for causing the change in the impedance provided by variable impedance circuit 159 and for pulling down anode voltage 120. Because the variable current source does not activate phosphors 125, this embodiment provides the benefit of improved black level of display device 102 during the discharge mode of operation.

In summary, the invention is for a field emission display having an anode voltage pull-down circuit connected to the anode of the field emission display. The anode voltage pull-down circuit has a discharge mode configuration, which is employed to reduce the potential at the anode. Preferably, the anode voltage pull-down circuit provides the benefit of reducing or eliminating activation of the phosphors during the step of reducing the anode voltage. The preferred method for operating a field emission display in accordance with the invention includes the steps of reducing a potential at the anode and, thereafter, causing a discharge current to be emitted from the electron emitters for neutralizing positively electrostatically charged surfaces within the field emission display. The field emission display and method of the invention provide numerous benefits, such as improved power requirements, improved black level of the display device, and improved control over the response of the anode power supply and of the display plates to a reduction in anode voltage.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

We claim:

1. A field emission display comprising:

a cathode plate having a plurality of electron emitters;

an anode plate disposed to receive electrons emitted by the plurality of electron emitters and having an anode, the anode designed to be connected to a potential source; and an anode voltage pull-down circuit having an input and an output, wherein the output is connected to the anode, and wherein the input is designed to be connected to the potential source, and further having a variable current source having an input connected to the anode.

2. The field emission display as claimed in claim 1, wherein the anode voltage pull-down circuit further comprises a variable resistance/impedance circuit having an output and an input, wherein the output of the variable resistance/impedance circuit is connected to the input of the variable current source and is further connected to the anode, and wherein the input of the variable resistance/impedance circuit is designed to be connected to the potential source.

3. The field emission display as claimed in claim 1, wherein the anode voltage pull-down circuit further comprises a switch configured to allow disconnection of the potential source from the anode without causing disconnection of the variable current source from the anode.

4. The field emission display as claimed in claim 3, wherein the switch comprises a first field emission device having an anode and a cathode; a second field emission device having an anode, a gate, and a cathode; and a pull-up resistor, wherein the cathode of the first field emission device is connected to the input of the variable current source, wherein the cathode of the second field emission device is connected to the anode of the anode plate, wherein the anode of the first field emission device is connected to the gate of the second field emission device, wherein the anode of the second field emission device is designed to be connected to the potential source, and wherein the pull-up resistor extends between the anode of the second field emission device and the anode of the first field emission device.

5. The field emission display as claimed in claim 4, wherein the switch further comprises a third field emission device having an anode and a cathode, wherein the anode of the third field emission device is connected to the anode of the anode plate and is further connected to the cathode of the second field emission device, and wherein the cathode of the third field emission device is connected to the input of the variable current source.

6. The field emission display as claimed in claim 4, wherein the switch further comprises a diode having an anode and a cathode, wherein the cathode of the second field emission device is connected to the anode of the diode, wherein the anode of the anode plate is connected to the anode of the diode, and wherein the anode of the first field emission device is connected to the cathode of the diode.

7. The field emission display as claimed in claim 1, wherein the variable current source comprises a first field effect transistor having a source and a drain and a second field effect transistor having a source and a drain, wherein the drain of the first field effect transistor is connected to the drain of the second field effect transistor, wherein the source of each of the first and second field effect transistors is connected to ground, and wherein the input of the variable current source is connected to the drain of the first field effect transistor.

8. The field emission display as claimed in claim 1, wherein the variable current source comprises a field emission device having an anode, and wherein the input of the variable current source is connected to the anode of the field emission device.

9. A field emission display comprising:

a cathode plate having a plurality of electron emitters;

an anode plate disposed to receive electrons emitted by the plurality of electron emitters and having an anode, the anode designed to be connected to a potential source; and an anode voltage pull-down circuit having an input and an output, wherein the output is connected to the anode, and wherein the input is designed to be connected to the potential source, and further having a shunt resistor designed to be connected to the anode.

10. The field emission display as claimed in claim 9, further including a switch configured to allow disconnection of the shunt resistor from the anode without causing disconnection of the potential source from the anode.

11. The field emission display as claimed in claim 9, further including a switch configured to allow disconnection of the potential source from the anode without causing disconnection of the shunt resistor from the anode.

12. The field emission display as claimed in claim 9, wherein the shunt resistor comprises a spacer extending between the cathode plate and the anode.

13. A field emission display comprising:

a cathode plate having a plurality of electron emitters;

an anode plate disposed to receive electrons emitted by the plurality of electron emitters and having an anode, the anode designed to be connected to a potential source; and a transformer having a primary coil and a secondary coil, wherein the secondary coil has an input designed to be connected to the potential source and an output connected to the anode, and wherein the primary coil is designed to be driven by an electrical pulse.

14. A field emission display comprising:

a cathode plate having a plurality of electron emitters;

an anode plate disposed to receive electrons emitted by the plurality of electron emitters and having an anode, the anode designed to be connected to a potential source; and an anode voltage pull-down circuit having an input and an output, wherein the output is connected to the anode, and wherein the input is designed to be connected to the potential source, further having an inductor designed to be connected to the anode, and further having a switch configured to allow disconnection of the inductor from the anode without causing disconnection of the potential source from the anode.

15. The field emission display as claimed in claim 14, wherein the anode voltage pull-down circuit further comprises a second switch configured to allow disconnection of the potential source from the anode without causing disconnection of the inductor from the anode.

16. A field emission display comprising:

a cathode plate having a plurality of electron emitters;

an anode plate disposed to receive electrons emitted by the plurality of electron emitters and having an anode, the anode designed to be connected to a potential source; and a variable resistance/impedance circuit having an output and an input, wherein the output of the variable resistance/impedance circuit is connected to the anode, wherein the input of the variable resistance/impedance circuit is designed to be connected to the potential source, wherein the variable resistance/impedance circuit is designed to provide a first resistance/impedance during a scanning mode of operation of the field emission display and a second resistance/impedance during a discharge mode of operation of the field emission display, and wherein the first resistance/impedance is lower than the second resistance/impedance.

17. The field emission display as claimed in claim 16, wherein the variable resistance/impedance circuit comprises a first resistor and a second resistor connected in parallel and further comprises a switch configured to prevent current flow through the second resistor without preventing current flow through the first resistor, and wherein the resistance of the first resistor is greater than the resistance of the second resistor.

18. The field emission display as claimed in claim 16, wherein the variable resistance/impedance circuit comprises a current-limiter circuit.

19. A field emission display comprising:

a cathode plate having a plurality of electron emitters;

an anode plate disposed to receive electrons emitted by the plurality of electron emitters and having an anode, the anode designed to be connected to a potential source; and an anode voltage pull-down circuit having an input and an output, wherein the output is connected to the anode, and wherein the input is designed to be connected to the potential source, further having a scanning mode configuration, and ether having a discharge mode configuration.

20. The field emission display as claimed in claim 19, wherein the anode voltage pull-down circuit comprises a variable current source having an input connected to the anode, and wherein the discharge mode configuration is characterized by an anode voltage pull-down current flowing into the input of the variable current source.

21. The field emission display as claimed in claim 20, wherein the anode voltage pull-down circuit further comprises a switch configured to allow disconnection of the potential source from the anode without causing disconnection of the variable current source from the anode, wherein the scanning mode configuration is characterized by the switch being closed, and wherein the discharge mode configuration is further characterized by the switch being open.

22. The field emission display as claimed in claim 20, wherein the variable current source comprises a first field effect transistor having a source and a drain and a second field effect transistor having a source and a drain, wherein the drain of the first field effect transistor is connected to the drain of the second field effect transistor, wherein the source of each of the first and second field effect transistors is connected to ground, and wherein the input of the variable current source is connected to the drain of the first field effect transistor.

23. The field emission display as claimed in claim 20, wherein the variable current source comprises a field emission device having an anode, and wherein the input of the variable current source is connected to the anode of the field emission device.

24. The field emission display as claimed in claim 19, wherein the anode voltage pull-down circuit comprises a shunt resistor designed to be connected to the anode.

25. The field emission display as claimed in claim 24, further including a switch configured to allow disconnection of the shunt resistor from the anode without causing disconnection of the potential source from the anode, wherein the scanning mode configuration is characterized by the switch being open, and wherein the discharge mode configuration is characterized by the switch being closed.

26. The field emission display as claimed in claim 24, wherein the anode voltage pull-down circuit further comprises a switch configured to allow disconnection of the potential source from the anode without causing disconnection of the shunt resistor from the anode, wherein the scanning mode configuration is characterized by the switch being closed, and wherein the discharge mode configuration is characterized by the switch being open.

27. The field emission display as claimed in claim 24, wherein the shunt resistor comprises a spacer extending between the cathode plate and the anode.

28. The field emission display as claimed in claim 19, wherein the anode voltage pull-down circuit comprises a variable resistance/impedance circuit having an output and an input, wherein the output of the variable resistance/impedance circuit is connected to the anode, wherein the input of the variable resistance/impedance circuit is designed to be connected to the potential source, wherein the scanning mode configuration is characterized by a first resistance/impedance provided by the variable resistance/impedance circuit, wherein the discharge mode configuration is characterized by a second resistance/impedance provided by the variable resistance/impedance circuit, and wherein the first resistance/impedance is lower than the second resistance/impedance.

29. The field emission display as claimed in claim 28, wherein the variable resistance/impedance circuit comprises a first resistor and a second resistor connected in parallel and further comprises a switch configured to prevent current flow through the second resistor without preventing current flow through the first resistor, and wherein the resistance of the first resistor is greater than the resistance of the second resistor.

30. The field emission display as claimed in claim 28, wherein the variable resistance/impedance circuit comprises a current-limiter circuit, wherein the scanning mode configuration is characterized by a first impedance provided by the current limiter circuit, wherein the discharge mode configuration is characterized by a second impedance provided by the current limiter circuit, and wherein the first impedance is lower than the second impedance.

31. The field emission display as claimed in claim 19, wherein the anode voltage pull-down circuit comprises a transformer having a primary coil and a secondary coil, wherein the secondary coil has an input designed to be connected to the potential source and an output connected to the anode, wherein the scanning mode configuration is characterized by the primary coil not being driven, and wherein the discharge mode configuration is characterized by the primary coil being driven by an electrical pulse.

32. The field emission display as claimed in claim 19, wherein the anode voltage pull-down circuit comprises an inductor designed to be connected to the anode and further comprises a switch configured to allow disconnection of the inductor from the anode without causing disconnection of the potential source from the anode.

33. The field emission display as claimed in claim 32, wherein the anode voltage pull-down circuit further comprises a second switch configured to allow disconnection of the potential source from the anode without causing disconnection of the inductor from the anode.

34. A switch comprising:

a first field emission device having an anode and a cathode;

a second field emission device having an anode, a gate, and a cathode, wherein the anode of the first field emission device is connected to the gate of the second field emission device, and wherein the anode of the second field emission device is designed to be connected to a potential source; and a pull-up resistor extending between the anode of the second field emission device and the anode of the first field emission device.

35. The switch as claimed in claim 34, wherein the cathode of the first field emission device is designed to be connected to the input of a variable current source.

36. The switch as claimed in claim 34, further comprising a third field emission device having an anode, wherein the anode of the third field emission device is connected to the cathode of the second field emission device.

37. The switch as claimed in claim 36, wherein the third field emission device further comprises a cathode, and wherein the cathode of the third field emission device is designed to be connected to the input of a variable current source.

38. The switch as claimed in claim 34, further comprising a diode having an anode and a cathode, wherein the cathode of the second field emission device is connected to the anode of the diode, and wherein the anode of the first field emission device is connected to the cathode of the diode.

39. A method for operating a field emission display having an anode and a plurality of electron emitters, the method comprising the steps of:

reducing a potential at the anode; and thereafter, causing a discharge current to be emitted from the plurality of electron emitters for neutralizing a positively electrostatically charged surface within the field emission display.

40. The method for operating a field emission display as claimed in claim 39, further comprising, prior to the step of reducing a potential at the anode, the step of providing at the anode a positive potential of greater than 600 volts.

41. The method for operating a field emission display as claimed in claim 40, wherein the step of providing a positive potential comprises the step of providing at the anode a positive potential of greater than 1000 volts.

42. The method for operating a field emission display as claimed in claim 41, wherein the step of providing a positive potential comprises the step of providing at the anode a positive potential of greater than 3000 volts.

43. The method for operating a field emission display as claimed in claim 39, wherein the step of causing a discharge current to be emitted from the plurality of electron emitters comprises the step of causing each of the plurality of electron emitters to emit electrons simultaneously.

44. The method for operating a field emission display as claimed in claim 39, wherein the step of causing a discharge current to be emitted from the plurality of electron emitters comprises the step of causing a discharge current to be emitted from the plurality of electron emitters at the end of a display frame.

45. The method for operating a field emission display as claimed in claim 39, wherein the step of reducing a potential at the anode comprises the step of controllably reducing a potential at the anode.

* * * * *

UNITED STATES PATENT AND TRADEMARK OFFICE

CERTIFICATE OF CORRECTION

PATENT NO. : 6,031,336
DATED : February 29, 2000
INVENTOR(S) : Rumbaugh et al.

It is certified that error appears in the above-identified patent and that said Letters Patent is hereby corrected as shown below:

Claim 19,
Line 66, delete "ether" and insert -- further --

Signed and Sealed this

Sixth Day of November, 2001

*Attest:*

Nicholas P. Godici

*Attesting Officer*

NICHOLAS P. GODICI
*Acting Director of the United States Patent and Trademark Office*